US009364799B2

(12) United States Patent
Son

(10) Patent No.: US 9,364,799 B2
(45) Date of Patent: Jun. 14, 2016

(54) SEPARATE FLOW PATH TYPE OF GAS-AIR MIXING DEVICE

(75) Inventor: Seung kil Son, Bucheon-si (KR)

(73) Assignee: Kyungdong Navien Co., Ltd., Pyeongtaek-si, Gyeonggi-do (KR)

( * ) Notice: Subject to any disclaimer, the term of this patent is extended or adjusted under 35 U.S.C. 154(b) by 441 days.

(21) Appl. No.: 13/979,082

(22) PCT Filed: Dec. 20, 2011

(86) PCT No.: PCT/KR2011/009888

§ 371 (c)(1),
(2), (4) Date: Jul. 10, 2013

(87) PCT Pub. No.: WO2012/134033

PCT Pub. Date: Oct. 4, 2012

(65) Prior Publication Data

US 2013/0294192 A1 Nov. 7, 2013

(30) Foreign Application Priority Data

Mar. 25, 2011 (KR) ..... 10-2011-0026776
Aug. 24, 2011 (KR) ..... 10-2011-0084417

(51) Int. Cl.
*B01F 3/02* (2006.01)
*F23D 14/62* (2006.01)

(Continued)

(52) U.S. Cl.
CPC ..... *B01F 3/028* (2013.01); *F23D 14/02* (2013.01); *F23D 14/36* (2013.01); *F23D 14/60* (2013.01);

(Continued)

(58) Field of Classification Search
CPC ..... F23D 14/62; F23D 14/02; F23D 2900/14642; F23D 14/60; B01F 3/028; F16K 11/04; F16K 31/02; F23N 1/02; F23N 2035/18
USPC ..... 366/167.1, 172.1, 173.1, 173.2
See application file for complete search history.

(56) References Cited

U.S. PATENT DOCUMENTS 1,664,318 A * 3/1928 Peebles ..... F23D 14/60 236/15 BD
1,684,500 A * 9/1928 McKee ..... F23D 14/60 48/184

(Continued)

FOREIGN PATENT DOCUMENTS

EP 0275439 A1 12/1987
GB 783699 A * 9/1957 ..... F23N 5/107

(Continued)

OTHER PUBLICATIONS

English language Abstract for JP 11-211023 A.

(Continued)

*Primary Examiner* — Tony G Soohoo
(74) *Attorney, Agent, or Firm* — Novick, Kim & Lee, PLLC; Jae Youn Kim

(57) ABSTRACT

According to the present invention, a gas-air mixing device used in a gas boiler includes: a gas supply tube branched into a first gas flow path and a second gas flow path; an air supply tube branched into a first air flow path and a second air flow path by means of an air-flow-path branching apparatus; a pressure valve which is connected to the inlet side of the gas supply tube in order to adjust the supply rate of gas being supplied to the gas supply tube; and a drive unit in which two valve bodies are connected to a rod that moves vertically up and down due to the magnetic force of an electromagnet; and the air-flow-path branching apparatus is formed to have a slot that connects to either the first air flow path or the second air flow path, and has a joining part which the rod can pass through in a position corresponding to the slot.

10 Claims, 7 Drawing Sheets

(51) Int. Cl.

| | |
|---|---|
| ***F23N 1/02*** | (2006.01) |
| ***F23D 14/36*** | (2006.01) |
| ***F23D 14/60*** | (2006.01) |
| ***F23N 1/00*** | (2006.01) |
| ***F23D 14/02*** | (2006.01) |

(52) U.S. Cl.
CPC ..... *F23D 14/62* (2013.01); *F23N 1/005* (2013.01); *F23N 1/02* (2013.01); *F23N 2033/08* (2013.01); *F23N 2035/06* (2013.01); *F23N 2035/18* (2013.01)

(56) References Cited

U.S. PATENT DOCUMENTS

| | | | | | |
|---|---|---|---|---|---|
| 2,731,036 | A | * | 1/1956 | Hughes | F16K 1/44 137/625.34 |
| 3,012,583 | A | * | 12/1961 | Gorgens | F16K 1/44 137/625.34 |
| 4,417,868 | A | * | 11/1983 | Putnam | F23M 20/005 181/229 |
| 4,602,610 | A | * | 7/1986 | McGinnis | F23N 1/005 126/110 E |
| 5,088,916 | A | * | 2/1992 | Furuhashi | F23D 14/60 239/414 |
| 5,168,898 | A | * | 12/1992 | Gottling | F16K 1/44 137/625.34 |
| 5,525,054 | A | | 6/1996 | Nakaura et al. | |
| 5,661,905 | A | | 9/1997 | Nakaura et al. | |
| 6,604,938 | B1 | * | 8/2003 | Blaauwwiekel | F23D 14/04 137/513.7 |
| 2003/0013057 | A1 | | 1/2003 | Vegter | |
| 2010/0330520 | A1 | * | 12/2010 | Kanda | F23D 14/60 431/350 |
| 2011/0139045 | A1 | * | 6/2011 | Zatti | F23D 14/60 110/188 |
| 2013/0294192 | A1 | * | 11/2013 | Son | B01F 3/028 366/182.4 |

FOREIGN PATENT DOCUMENTS

| | | | |
|---|---|---|---|
| JP | 06-040618 | U | 5/1994 |
| JP | 11-211023 | A | 8/1999 |
| JP | 2001-099410 | A | 4/2001 |
| KR | 10-0126903 | B1 | 12/1997 |
| KR | 10-0371208 | B1 | 1/2003 |
| KR | 10-0805630 | B1 | 2/2008 |

OTHER PUBLICATIONS

English language Abstract for KR 10-0126903 B1.
English language Abstract for JP 2001-099410 A.
English language Abstract for KR 10-0805630 B1.
English language Abstract for KR 10-0371208 B1.
International Search Report mailed on Jul. 2, 2012.
English language Abstract for EP 0275439 A1.
Australian Patent Examination Report No. 1 dated Dec. 18, 2014.

* cited by examiner

SEPARATE FLOW PATH TYPE OF GAS-AIR MIXING DEVICE

TECHNICAL FIELD

The present invention relates to a gas-air mixing device of a gas boiler, and more particularly, to a separate flow path type of gas-air mixing device for improving a turn-down ratio.

BACKGROUND ART

In general, various types of boilers used for heating have been developed and used in accordance with a required floor space or installation purpose as an oil boiler, a gas boiler, and an electric boiler in accordance with supplied fuel.

Among these boilers, particularly, in the gas boiler, as a general method for combustion of gas fuel, in the case of a pre-mixed burner, the gas fuel is combusted by mixing gas and air at a mixing ratio of an optimal combustion state in advance and then supplying mixture gas (air+gas) to a flame hole surface.

Further, in the gas boiler, a turn-down ratio (TDR) is set. The turn-down ratio (TDR) represents a 'ratio of a minimum consumed gas amount to a maximum consumed gas amount' in a gas combustion device in which the amount of gas is variably controlled. For example, when the maximum consumed gas amount is 24,000 kcal/h and the minimum consumed gas amount is 8,000 kcal/h, the turn-down ratio (TDR) is 3:1. The turn-down ratio (TDR) is limited according to how low the minimum consumed gas amount for maintaining a stable flame can controllably be.

In the case of the gas boiler, as the turn-down ratio (TDR) increases, convenience in heating and using hot water is increased. That is, when a burner operates in a region where the turn-down ratio (TDR) is low (that is, when the minimum consumed gas amount is large), and loads of the heating and the hot water are small, the boiler is frequently turned on and off, and as a result, a deviation in controlling a temperature is increased and durability of the device deteriorates. Accordingly, a method for improving the turn-down ratio (TDR) of the burner applied to the gas boiler has been suggested.

FIG. 1 is a graph illustrating a relationship between a consumed gas amount and pressure, FIG. 2 is a schematic diagram illustrating a combustion device in the related art, and FIG. 3 is a graph illustrating a relationship between an oxygen concentration and a dew-point temperature. A problem of the combustion device in the related art will be described with reference to FIGS. 1 to 3.

In a gas-air mixing device using a pneumatic valve, gas flows into an air supply tube by differential pressure between gas pressure of a gas supply tube and air pressure of the air supply tube to become a gas-air mixture.

Basic elements that limit a turn-down ratio (TDR) of a gas burner in the gas-air mixing device using the pneumatic valve may be a relationship between a consumed gas amount Q and differential pressure ΔP as illustrated in FIG. 1, and generally, the relationship between the differential pressure and a flow rate of a fluid is as follows.

$$Q=k\sqrt{\Delta P}$$

That is, the differential pressure needs to be increased four times in order to increase the flow rate of the fluid twice. Therefore, a ratio of the differential pressure needs to be 9:1 in order to set the turn-down ratio (TDR) to 3:1 and a ratio of the differential pressure needs to be 100:1 in order to set the turn-down (TDR) to 10:1, and there is a problem in that it is impossible to infinitely increase supply pressure of gas.

Meanwhile, in the gas-air mixing device using a gas valve of current proportional control type, the flow rate of gas has a relationship that is proportional to the square root of gas supply pressure P.

When FIG. 5 is described as an example, the differential pressure ΔP represents differential pressure between air pressure Pb of an air flow path b and gas pressure Pa of a gas path a, Pa−Pb, and it is experimentally known that when a valve at an inlet side of the gas supply tube is closed, control reliability can be secured only in the case where the gas pressure Pa of the gas supply tube is minimum 5 $mmH_2O$ or more, that is, the pressure of the gas supply tube is lower than atmospheric pressure by 5 $mmH_2O$ or more.

In order to solve a problem in that it is impossible to infinitely increase the gas supply pressure, a method has been presented, which increases the turn-down ratio (TDR) of the gas burner by partitioning the burner into several regions as illustrated in FIG. 2 and opening and closing a passage of gas injected to each burner.

In the combustion device of FIG. 2, when a region of a burner 20 is divided into a first-stage region 21 and a second-stage region 22 at a ratio of 4:6, valves 31 and 32 are mounted on the respective gas passages, and a proportional control valve 33 is installed on a supply flow path of gas in order to combust gas by controlling a supply rate of gas in accordance with fire power of the burner, a proportional control region illustrated in a table below can be acquired. In this case, it is assumed that the turn-down ratio (TDR) of each burner region is 3:1. At this time, a main valve 34 is installed at a gas inlet side of the proportional control valve 33 and the main valve 34 as an on/off valve determines whether to supply gas by opening and closing operations and is generally constituted by a drive unit.

TABLE 1

| Classification | Maximum gas amount | Minimum gas amount |
|---|---|---|
| First stage only | 40% | 13% |
| Second stage only | 60% | 20% |
| First stage + second stage | 100% | 33% |

That is, when a maximum gas amount is 100%, since a proportional control from 13% to 100% can be achieved, the turn-down ratio (TDR) is approximately 7.7:1. However, when the combustion device having such a structure is applied to a condensing boiler, there is a problem as follows.

The condensing boiler uses a method that increases efficiency of a gas boiler by condensing vapor included in exhaust gas and collecting latent heat of the condensed vapor through a heat exchanger. Accordingly, since the vapor is more easily condensed as a dew-point temperature of the exhaust gas increases, the efficiency of the boiler is improved.

However, the dew-point temperature of the exhaust gas increases as a volume ratio (%) of the vapor included in the exhaust gas increases, and the amount of excess air (refers to oxygen and nitrogen which do not participate in a combustion reaction among constituents of the exhaust gas, $H2O+CO_2+O_2+N_2$) contained in the exhaust gas needs to be small in order to increase the volume ratio of the vapor.

However, when an oxygen concentration in the exhaust gas increases (that is, the amount of the excess air increases) as illustrated in FIG. 3, the dew-point temperature rapidly decreases, and as a result, the efficiency of the condensing boiler deteriorates.

Therefore, when the region of the burner 20 is divided into the first-stage region 21 and the second-stage region 22 as illustrated in FIG. 2, air is supplied by a blower 10 up to the second-stage region 22 of the burner 20 even in the case where combustion is performed only in the first-stage region 21, and as a result, the oxygen concentration in the exhaust gas becomes very high.

Further, since the temperature of the excess air increases to a temperature of discharge gas, a part of heat by fuel combustion is used to increase the temperature of the excess air, and as a result, heat loss occurs.

Therefore, when the combustion device illustrated in FIG. 2 is applied to the condensing boiler, there is a problem in that it is difficult to anticipate high efficiency in a low-output region (that is, when combustion is performed only in the first-stage region or the second-stage region).

Meanwhile, when the pneumatic gas valve is applied, the turn-down ratio is determined depending on a blowing capability of the blower. However, since most blowers are easily controlled in a region of 1,000 to 5,000 rpm, the turn-down ratio, which can be acquired by the blower, is 5:1. In order to set the turn-down ratio to 10:1 by applying the pneumatic gas valve, the blower needs to operate in the speed range of 1,000 to 10,000 rpm, but the blower is very expensive and it is difficult to find a product commercialized for use in the gas boiler.

Further, as illustrated in FIG. 4, a type is known, which adopts a separation film A configured so that one end thereof is formed by a hinge and the other end thereof is formed as a free end for branched air flow path, such that the other end thereof can pivot around a hinge as marked with a dotted line.

However, the above type is configured so that when the other end thereof falls in a free fall scheme by a self weight, and negative pressure is applied by the blower, air flows in by a pressure difference and thus, the separation film A is lifted up by the speed of the air that flows in, and there is a problem in that, when the amount of air is variable, the separation film vibrates vertically such that an operation is instable. Moreover, when dust or foreign materials are accumulated in the hinge, there is also a problem in that the operation is not smooth.

PRIOR ART

Patent Document (Patent Document 0001) Korean Patent No. 10-0805630 Feb. 20, 2008

DISCLOSURE

Technical Problem

The present invention is contrived to provide a gas-air mixing device that is high in thermal efficiency and simple in structure, and solves instability in operation of the existing separation film type while improving a turn-down ratio.

Technical Solution

A gas-air mixing device used in a gas boiler according to the present invention includes: a gas supply tube branched into a first gas flow path and a second gas flow path; an air supply tube branched into a first air flow path and a second air flow path by an air flow path branching apparatus; a pneumatic valve connected to an inlet side of the gas supply tube in order to control a gas supply rate supplied to the gas supply tube; and a drive unit having two valve bodies connected to a rod that moves vertically up and down by magnetic force of an electromagnet, in which a slot which is communicatable with any one air flow path of the first air flow path and the second air flow path and a joining part through which the rod is able to pass at a position corresponding to the slot are formed in the air flow path branching apparatus.

Further, the air flow path branching apparatus is constituted by two air flow path guides.

In addition, in the gas-air mixing device used in a gas boiler according to the present invention, the two valve bodies may be controlled to close both any one gas flow path of the gas flow paths and the slot in a low-output mode in which a consumed gas amount is small.

Moreover, in the gas-air mixing device used in a gas boiler according to the present invention, nozzles may respectively be installed on gas flow paths at an outlet side of the gas supply tube of the plurality of gas auxiliary valves.

Also, hole sizes of the nozzles of the gas flow paths may be different from each other.

Further, in the gas-air mixing device used in a gas boiler according to the present invention, a main valve, which serves as an opening/closing valve as an on/off valve, may be connected to an inlet side of the gas supply tube of the pneumatic valve.

Also, the nozzles of the gas flow paths may be arranged in parallel to each other.

In addition, a blower for supplying air required for combustion may be connected to an inlet side of the air supply tube.

Another gas-air mixing device used in a gas boiler according to the present invention includes: an air supply tube branched into a first air flow path at an upper side and a second air flow path at a lower side by an air flow path branching apparatus; a gas supply tube branched into a first gas flow path and a second gas flow path; a pneumatic valve connected to an inlet side of the gas supply tube in order to control a gas supply rate supplied to the gas supply tube; and a drive unit having one valve body connected to a rod that moves vertically up and down by magnetic force of an electromagnet, in which the first gas flow path extends up to a boundary of the first air flow path and the second air flow path.

Further, in another gas-air mixing device used in a gas boiler according to the present invention, the first gas flow path may be connected with two air flow path guides that extend in parallel with the longitudinal direction of the air supply tube.

In addition, in another gas-air mixing device used in a gas boiler according to the present invention, the valve body may be controlled to close the first gas flow path in a low-output mode in which a consumed gas amount is small.

ADVANTAGEOUS EFFECTS

According to the present invention, since supply rates of air and gas in a minimum output are approximately ½ of supply rates of air and gas in a maximum output, it is possible to expect an advantageous effect in that a problem of efficiency deterioration by excess air does not occur, unlike the related art.

Further, when a current proportional control type of gas valve is adopted, since a current value to control opening and closing of the gas valve is changed depending on the speed (rpm) of a blower, a controller for the blower which links with the opening and closing of the gas valve needs to be provided. On the contrary, in a gas-air mixing device adopting a pneumatic valve according to the present invention, since gas and air is already mixed to become a mixture before flowing into a mixed-gas flow path, such a controller is not required.

Further, according to the present invention, the gas-air mixing device can be compactly configured by reducing the width of the air flow path, and flow noise can be reduced and flow loss can be minimized by simplifying the flow path.

BEST MODE

Figure 1:
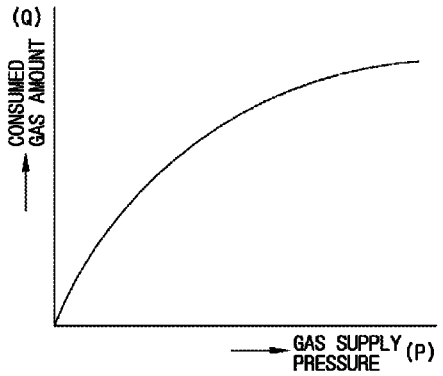
FIG. 1 is a graph illustrating a relationship between a consumed gas amount and pressure.

Hereinafter, preferred embodiments of the present invention will be described in detail with reference to the accompanying drawings. In the drawings, similar or like reference numerals refer to similar or like elements.

An exemplary embodiment of a separate flow path type of gas-air mixing device according to an embodiment of the present invention will be described with reference to FIGS. 5 and 6.

In the separate flow path type of gas-air mixing device according to the present invention, a gas supply tube 112 of fuel gas is branched into a plurality of gas flow paths, for example, two gas flow paths 115 and 116, and an air supply tube 113 is branched into a plurality of air flow path, for example, two air flow paths 117 and 118.

Figure 6:
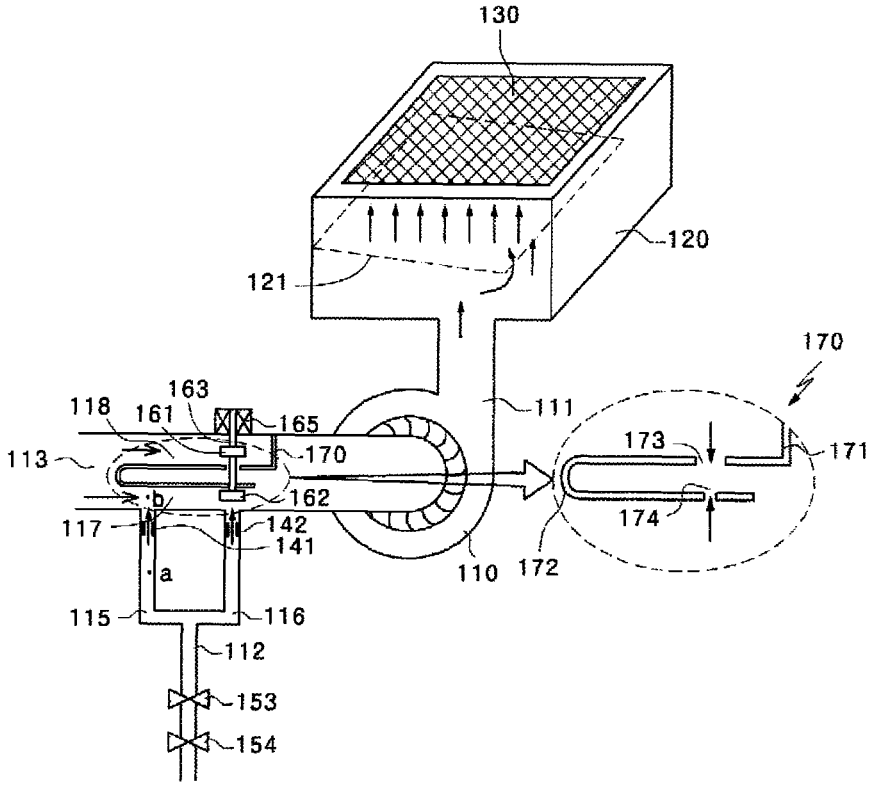
FIG. 6 is a schematic diagram illustrating a configuration in a high-output mode in the combustion device including the separate flow path type of gas-air mixing device according to an exemplary embodiment of the present invention.

FIG. 6 schematically illustrates a case where the separate flow path type of gas-air mixing device according to the present invention is in a high-output mode. Referring to FIG. 6, the air supply tube 113 is branched into the two air-path-flows 117 and 118 by, for example, air flow path branching apparatus 170. The air flow path branching apparatus 170 may be constituted by, for example, an "L"-shaped air flow path guide 171 and a "C"-shaped air flow path guide 172. A slot 173 is formed between the air flow path guide 171 and the air flow path guide 172, and the slot 173 serves as an air passage through which air in the air flow path 118 may pass.

Further, a joining part 174, which a rod 163 may pass through and be joined to, may be provided in the air flow path guide 172. Further, the rod 163 may even pass through the slot 173. To this end, the slot 173 and the joining part 174 are preferably formed at positions corresponding to each other.

A pneumatic valve 153 for controlling a supply rate of gas in accordance with fire power of a burner required in a proportional control combustion system is connected to the gas supply tube 112, and a main valve 154 is connected to an inlet side of the gas supply tube of the pneumatic valve 153. The main valve 154 as an on/off valve serves to supply gas by opening and closing operations.

Figure 2:
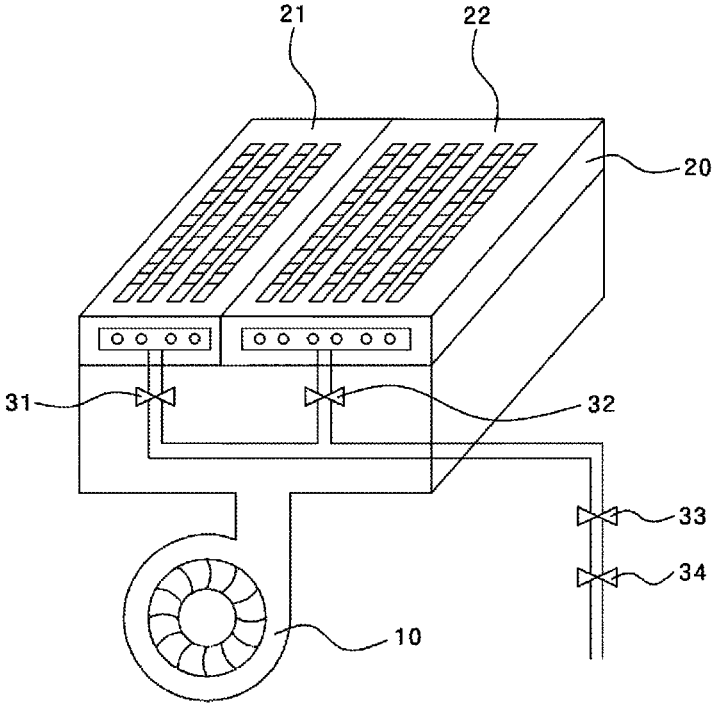
FIG. 2 is a schematic diagram illustrating a combustion device in the related art.
Figure 3:
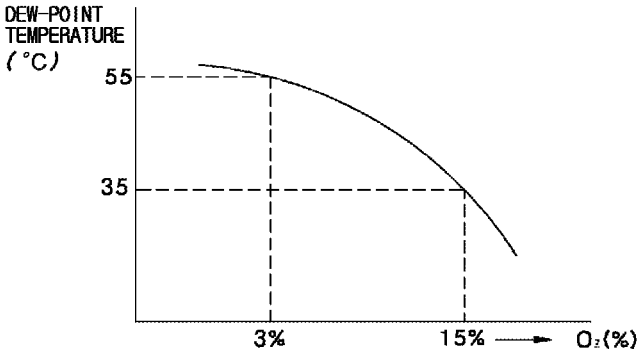
FIG. 3 is a graph illustrating a relationship between a oxygen concentration and a dew-point temperature.
Figure 4:
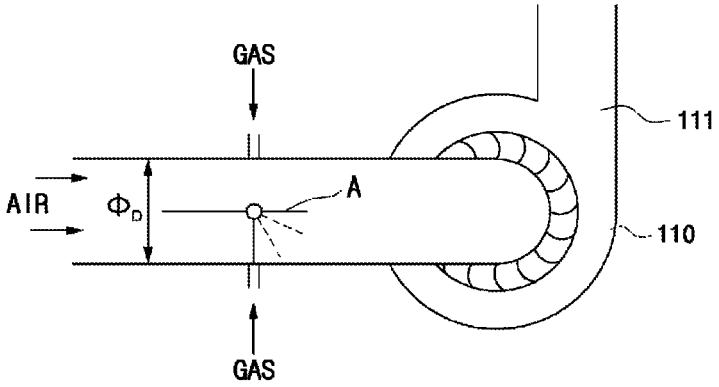
FIG. 4 is a diagram schematically illustrating another air flow path branching apparatus in the related art.

The air and the gas that pass through the air supply tube 113 and the gas supply tube 112 become an air-gas mixture in a mixed-gas flow path 111 branched from the air supply tube 113, and then is supplied to a mixing chamber 120. Further, a blower 110 for supplying air required in the air supply tube 113 is connected to a point where the air supply pipe 113 and the mixed-gas flow path 111 join. Further, as can be seen in FIGS. 5 and 6, the gas supply tube 112 is connected to the air supply tube 113, while in the structure adopting the current proportional control valve as illustrated in FIG. 2, the gas supply tube is directly connected to the mixing chamber 120.

Figure 5:
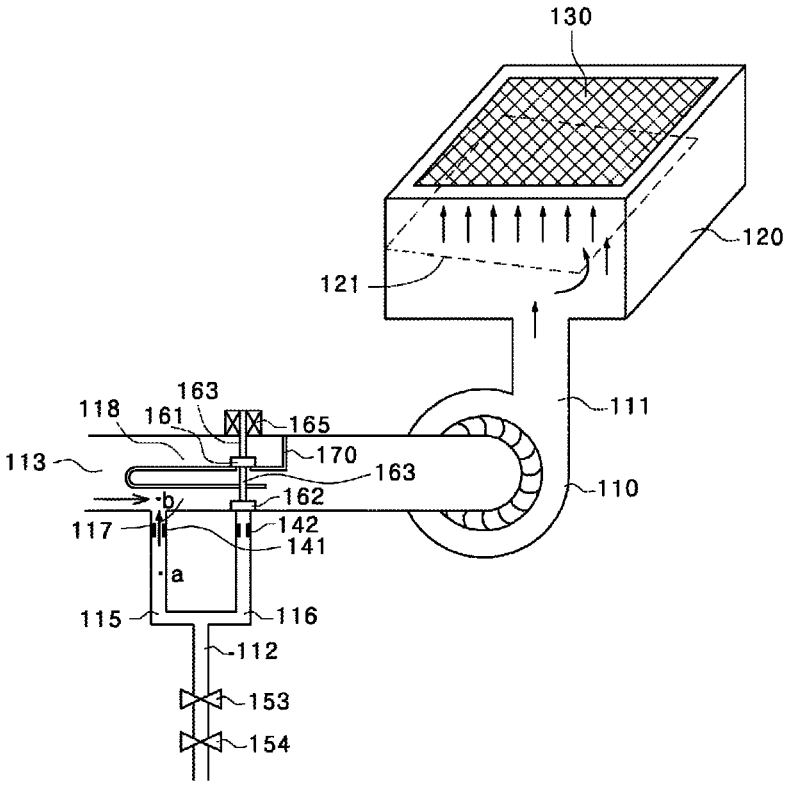
FIG. 5 is a schematic diagram illustrating a configuration in a low-output mode in a combustion device including a separate flow path type of gas-air mixing device according to an exemplary embodiment of the present invention.

FIGS. 5 and 6 schematically illustrate a drive unit and the drive unit is configured to include a rod 163 that moves vertically upward and downwards by magnetic force of an electromagnet 165 and two valve bodies 161 and 162 attached to the rod 163.

As illustrated in FIG. 5, when the valve bodies 161 and 162 close the slot 173 and the gas flow path 116, the air supplied to the air flow path 118 of the air supply tube 113 is blocked by the valve body 161 not to be supplied to the mixed-gas flow path 111 and the gas of the gas flow path 116 is blocked by the valve body 162 not to be supplied to the mixed-gas flow path 111.

Consequently, the air is supplied through only the air flow path 117 of the air supply tube 113 and the gas is supplied through only the gas flow path 115 of the gas supply tube 112. That is, in the configuration illustrated in FIG. 5, a low-output state in which the gas supply rate is small is obtained.

However, in FIG. 6, since the air and the gas may be supplied to the mixed-gas flow path 111 through the slot 173 and the gas flow path 116, respectively, the air and the gas supplied to the mixed-gas flow path 111 are increased as compared with the FIG. 5. That is, in the configuration illustrated in FIG. 6, a high-output state in which the gas supply rate is large is obtained.

However, since the gas is supplied through the two gas flow paths 115 and 116 in FIG. 6, the gas supply flow rate is twice larger than when the gas supply is blocked in the gas flow path 116 by the valve body in FIG. 5. However, since the differential pressure ΔP is actually decreased due to the speed $V_b$ at point b of the air flow path 117 in FIG. 6, the gas supply flow rate in FIG. 6 is not actually twice larger than the gas supply flow rate in FIG. 5.

A table below illustrates changes in gas supply rate depending on a change in speed of the blower in the low-output mode of FIG. 5 and the high-output mode of FIG. 6, respectively based on an experimental result.

TABLE 2

| RPM of | Low-output mode of FIG. 5 | | | | High-output mode of FIG. 6 | | | |
|---|---|---|---|---|---|---|---|---|
| blower | $Q_{air}$ | $V_b$ | ΔP | $Q_{gas}$ | $Q_{air}$ | $V_b$ | ΔP | $Q_{gas}$ |
| 1,000 | 10% | 1 | 1 | 10% | 18% | 0.9 | 0.81 | 18% |
| 2,000 | 20% | 2 | 4 | 20% | 36% | 1.8 | 3.24 | 36% |
| 3,000 | 30% | 3 | 9 | 30% | 54% | 2.7 | 7.29 | 54% |
| 4,000 | 40% | 4 | 16 | 40% | 72% | 3.6 | 12.96 | 72% |
| 5,000 | 50% | 5 | 25 | 50% | 90% | 4.5 | 20.25 | 90% |

Herein, $Q_{air}$ represents the air supply rate and $Q_{gas}$ represents the gas supply rate.

Referring to the above table based on the experimental result, it can be found that the gas supply rate $Q_{gas}$ in the high-output mode in which the valve is opened is approximately 1.8 times larger than that in the low-output mode in which the valve is closed.

Therefore, when a blower in which a ratio of a maximum rpm and a minimum rpm is 5:1 is used, the turn-down ratio may be approximately 9:1. That is, in order to acquire the turn-down ratio of 10:1, a blower in which the ratio of the maximum rpm and the minimum rpm ranges approximately from 6:1 to 7:1 needs to be used.

Further, optionally, nozzles 141 and 142 may be installed at outlet sides of the gas flow paths 115 and 116. Moreover, preferably, the nozzles 141 and 142 are installed in parallel on the gas flow paths 115 and 116.

The mixture of the mixing chamber 120 is supplied to a burner surface 130.

In the combustion device including the separate flow path type of gas-air mixing device according to the present invention, since the gas and the air are first mixed in the air supply tube 113 before entering the mixing chamber 120 to become a mixture, a controller may not be provided, which supplies only an amount of air required for combustion by controlling the rpm of the blower 10 depending on opening and closing the proportional control valve 33, unlike the gas boiler combustion device of FIG. 2, and as a result, the combustion device may be simply configured, and since the air supply rate may already be decreased in the air supply tube 113 in the low-output mode, an excess air amount supplied to the burner is remarkably reduced, and as a result, efficiency deterioration by excess air is significantly reduced.

A burner structure illustrated in FIGS. 5 and 6 includes the mixing chamber 120 to show a combustion structure of a pre-mixed burner. The pre-mixed burner pre-mixes the air and the gas to allow complete combustion and ejects the mixture to the burner surface 130 to achieve the combustion, and since the pre-mixed burner may perform combustion at a lower excess air ratio than a Bunsen burner, a dew-point temperature may be increased, and as a result, the pre-mixed burner is widely used particularly in the condensing boiler.

Although the nozzles 141 and 142 are exemplarily provided on the gas flow paths 115 and 116, respectively in the embodiment, two or more nozzles may be, of course, installed on the respective gas flow paths. A ratio in hole size of the nozzles 141 and 142 may be 5:5, but the hole sizes of the nozzles 141 and 142 may be different from each other like, for example, 4:6 in order to further increase the turn-down ratio (TDR).

The mixing chamber 120 as a place where the air and the gas are mixed is connected to the mixed-gas flow path 111 as described above. Further, an air distribution plate 121 is preferably installed in the mixing chamber 120 in order to smoothly mix the air and the gas by preventing the air and the gas from directly moving up to the burner surface 130.

For the burner surface 130, the existing used burner surface for pre-mixing may be used, for example, a metal fiber, ceramic, or a stainless perforated plate, or the like may be used.

Hereinafter, another embodiment of the present invention will be described with reference to FIG. 7.

The combustion device of the gas-air mixing device according to the embodiment illustrated in FIGS. 5 and 6 has a problem in that the air flow path branching apparatus 170, which is branched into the two air flow paths 117 and 118, makes the flow of the air unnatural, and a width $\chi_D$ of the air flow path needs to be increased in order to reduce pressure loss caused by the unnatural air flow.

Figure 7:
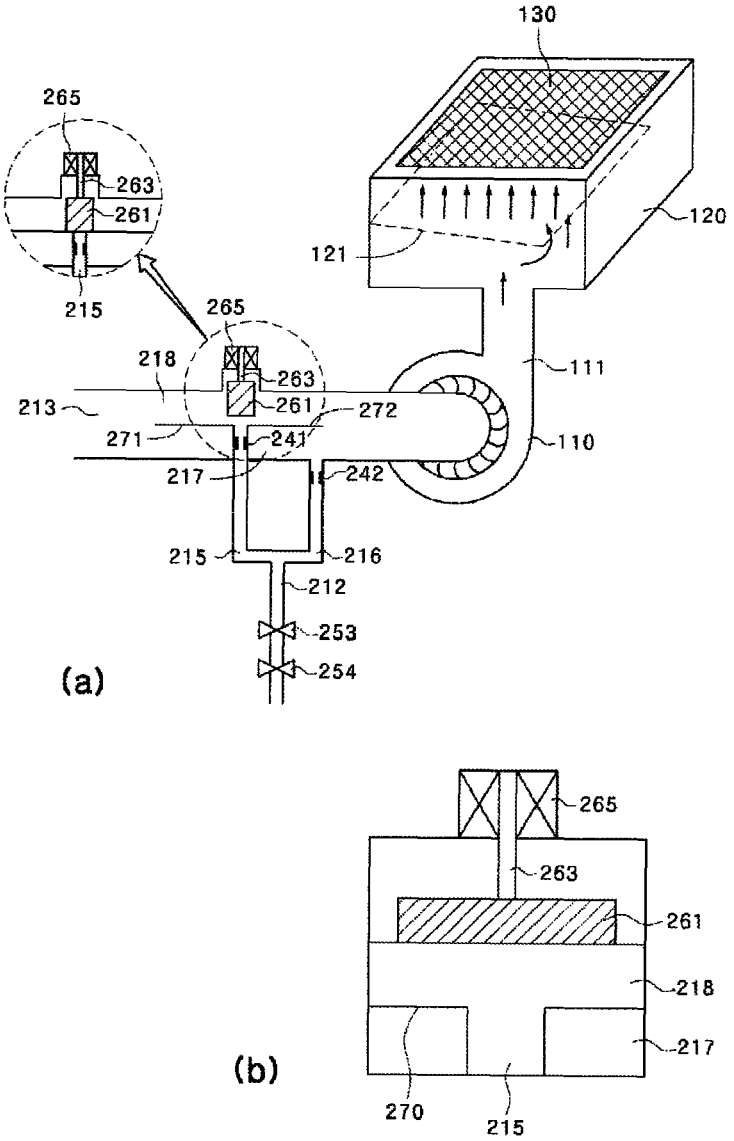
FIG. 7 is a schematic diagram illustrating a combustion device including a separate flow path type of gas-air mixing device according to another exemplary embodiment of the present invention.

The problem may be enhanced by another embodiment of the present invention illustrated in FIG. 7, and in a combustion device including the gas-air mixing device according to another embodiment of the present invention, any one gas flow path 215 of two gas flow paths 215 and 216 branched from a gas supply tube 212 extends to the inside of an air supply tube 213, preferably, to a boundary between two air flow paths 217 and 218 of the air supply tube 213.

Opening and closing the gas flow path 215 is controlled by a drive unit constituted by a rod 263, which moves vertically up and down by magnetic force of an electromagnet 265, and one valve body 261 attached to the rod 263. The gas flow path 215 is connected to air flow path guides 271 and 272 that extend horizontally in parallel with the longitudinal direction of the air supply tube 213 such that the air flow path guides 271 and 272, and the gas supply tube 215 preferably have substantially a Y shape, in order to branch the air supply tube 213 into the two air flow paths 217 and 218. The valve body 261 may land on the air flow path guides 271 and 272.

That is, the two valve bodies 161 and 162 are used to open and close the air flow path 118 and the gas flow path 116, respectively, in the embodiment of FIGS. 5 and 6, but in the embodiment of FIG. 7, as seen at a part marked with a dotted line in 7(*a*), when the valve body 261 lands on the gas flow path 215, the gas flow path 215 and the air flow path 218 are simultaneously blocked to be switched to the low-output mode as illustrated in FIG. 5.

Meanwhile, as seen in FIG. 7(*b*) which is a cross-sectional view cut in a direction vertical to the longitudinal direction of the air supply tube 213, openings are formed at the left and right sides of the gas supply tube 215 to allow air to pass through the other air flow path 217.

In the gas-air mixing device of the present invention according to FIG. 7, since the unnatural air flow does not occur, it is possible to anticipate an advantageous effect in that the flow loss deteriorates to reduce the width $\Phi_D$ of the air flow path.

Since a pneumatic valve 253, a main valve 254, and nozzles 241 and 242 of FIG. 7 correspond to the pneumatic valve 153, the main valve 154, and the nozzles 141 and 142 of FIGS. 5 and 6, a description thereof will be omitted.

Hereinafter, an operation of the present invention by the configuration will be described with reference to FIGS. 8 and 9.

Figure 8:
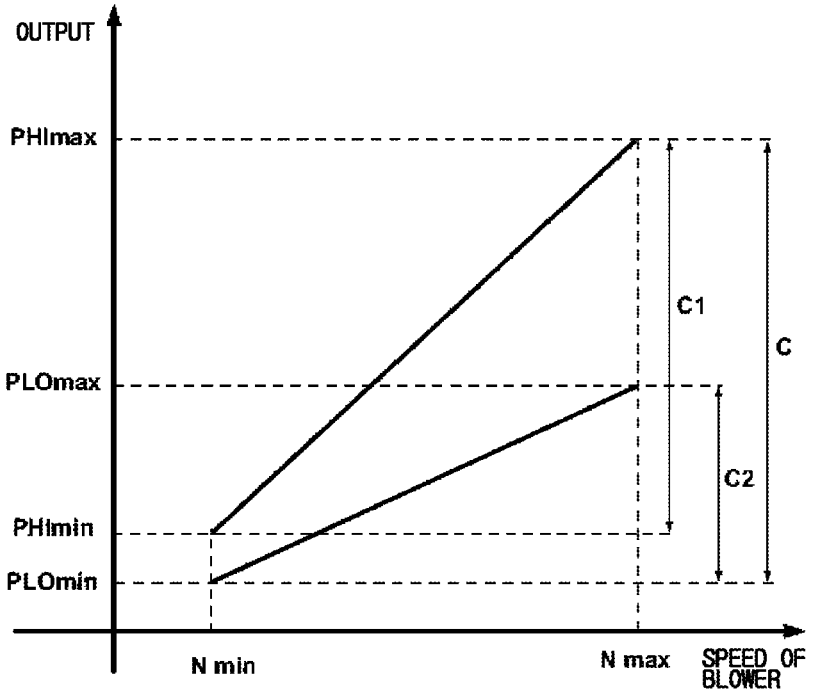
FIG. 8 is a graph illustrating a relationship between an output and a blower speed in the combustion device including the gas-air mixing device according to the present invention.

When a ratio of a maximum output and a minimum output, that is, a turn-down ratio is 5:1 at C1 of FIG. 8 and a pressure differential in the maximum output is 200 $mmH_2O$, the pressure differential needs to be 8 $mmH_2O$ (that is, $200/5^2$) in order to acquire an output which is ⅕of the maximum output, that is, the minimum output. As described above, the output and the flow rate have a relationship to be proportional to the square root of the pressure differential.

At this time, a minimum pressure differential needs to be decreased to 2 $mmH_2O$ (that is, $200/10^2$) in order to increase the turn-down ratio to 10:1 while maintaining the maximum output at the same value. However, as described above, since the combustion device needs to be generally used at the minimum 5 $mmH_2O$ or more in order to control the minimum gas amount, the value may not be practically permitted in a combustion control of the gas boiler.

However, when the separate flow path type of gas-air mixing device according to the present invention is adopted, when any one gas flow path of the two gas flow paths 115 and 116, that is, the gas flow path 116 is closed by using the valve body 162, and simultaneously, the slot 173 is closed by using the valve body 161 (C2 of FIG. 8), the flow rates of both the gas and the air supplied to the mixing chamber 120 through the mixed-gas flow path 111 may be 55% of the flow rate in the maximum output. Therefore, a mixing ratio of the gas and the air is maintained constantly, but the minimum output may become 55% of the maximum output. As a result, the minimum output of approximately 11% of the maximum output may be achieved while maintaining the pressure differential of 8 $mmH_2O$ as in the output maximum. That is, the turn-down ratio may be approximately 10:1 as illustrated in C of FIG. 8 by using the blower in which the ratio of the maximum rpm and the minimum rpm is 6:1.

As described above, the blower in which the ratio of the maximum rpm and the minimum rpm is approximately 6:1, and not 5:1 needs to be used in order to acquire the turn-down ratio of 10:1 because the loss of the pressure differential occurs in the separate flow path type of gas-air mixing device according to the present invention due to the influence of the air supply tube 113 and the boiler structure, and the like.

Figure 9:
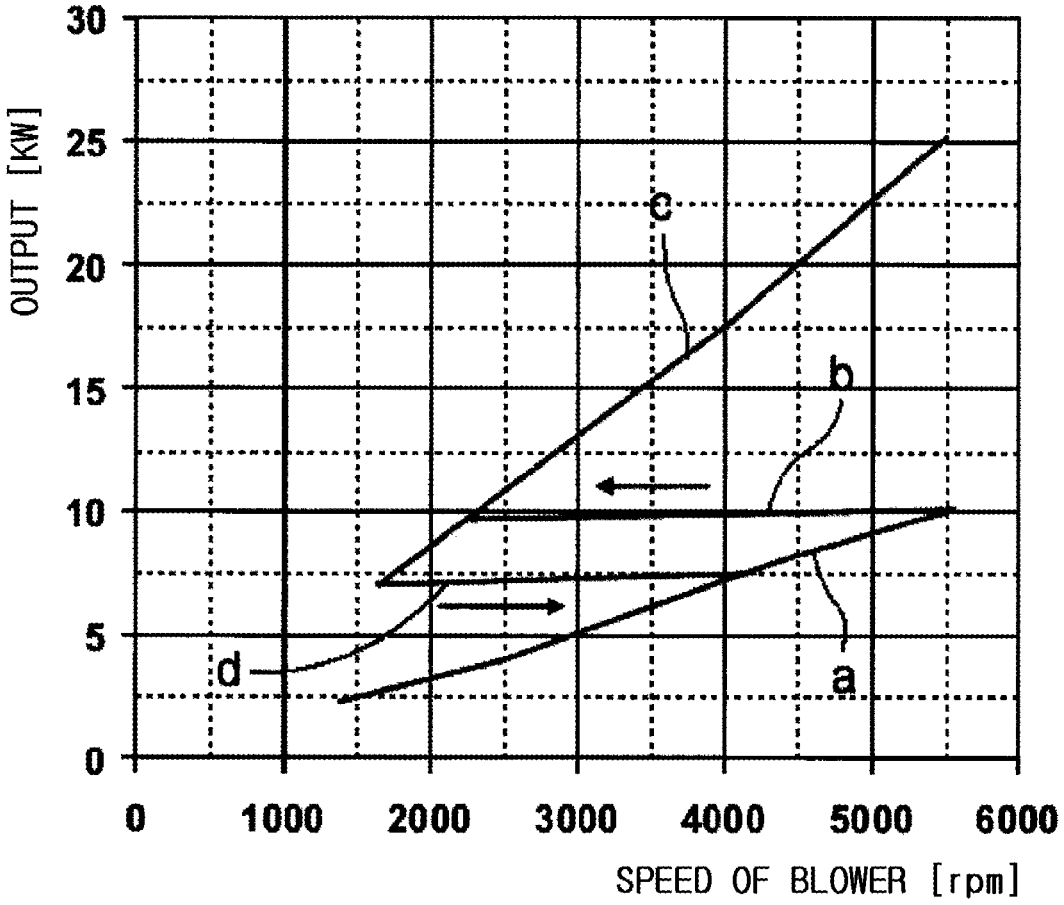
FIG. 9 is another graph illustrating a relationship of an output and a blower speed in the combustion device including the gas-air mixing device according to the present invention.

FIG. 9 exemplarily illustrates that the output increases in the range of 2.5 kw to 10 kw while being substantially proportional to the speed of the blower in the low-output mode in which loads of heating and hot water are small (line a of FIG. 9) and the output increases in the range of 7 kw to 25 kw while being substantially proportional to the speed of the blower in the high-output mode in which the loads of the heating and hot water are large (line c of FIG. 9). In this case, the turn-down ratio is 10:1 (that is, 25:2.5).

Line b of FIG. 9 indicates a case in which the low-output mode is switched to the high-output mode, and line d of FIG. 9 indicates a case in which the high-output mode is switched to the low-output mode.

The combustion device including the separate flow path type of gas-air mixing device according to the present invention may be, of course, applied to even a water heater, and the like, in addition to the gas boiler.

Although the specific preferred embodiments of the present invention have been illustrated and described as above, the present invention is not limited to the embodiments, and various changes and modifications can be made by those skilled in the art within the scope without departing from the spirit of the present invention. Further, the accompanied drawings are not illustrated according to a scale but partially upsized and downsized, in order to describe the spirit of the present invention.

DESCRIPTION OF MAIN REFERENCE NUMERALS OF DRAWINGS

110: Blower
111: Mixed-gas flow path
112, 212: Gas supply tube
113, 213: Air supply tube
115, 116, 215, 216: Gas flow path
117, 118, 217, 218: Air flow path
120: Mixing chamber
121: Air distribution plate
130: Burner surface
141, 142, 241, 242: Nozzle
161, 162, 261: Valve body
153, 253: Pneumatic valve
154, 254: Main valve
161, 162, 261: Valve body
170: Air flow path branching apparatus
171: L-shaped air flow path guide
172: C-shaped air flow path guide
173: Slot
174: Joining part
271, 272: Air flow path guide

The invention claimed is:

1. A gas-air mixing device used in a gas boiler, comprising:
a gas supply tube branched into a first gas flow path and a second gas flow path;
an air supply tube branched into a first air flow path and a second air flow path by an air flow path branching apparatus;
a pneumatic valve connected to an inlet portion of the gas supply tube in order to control a gas supply rate supplied to the gas supply tube; and
a drive unit having two valve bodies connected to a rod that moves vertically up and down by magnetic force of an electromagnet,
wherein the air flow path branching apparatus includes a slot which is communicatable with any one air flow path of the first air flow path and the second air flow path and a joining part through which the rod is able to pass through at a position corresponding to the slot.

2. The gas-air mixing device of claim 1, wherein the air flow path branching apparatus comprises two air flow path guides.

3. The gas-air mixing device of claim 1, wherein the two valve bodies are controlled to close both any one of the first gas flow path or the second gas flow path and the slot in a low-output mode.

4. The gas-air mixing device of claim 1, wherein each of the first and second gas flow paths includes a nozzle installed, respectively, at an outlet portion thereof.

5. The gas-air mixing device of claim 4, wherein hole sizes of the nozzles of the first and second gas flow paths are different from each other.

6. The gas-air mixing device of claim 4, wherein the nozzles of the first and second gas flow paths are arranged in parallel to each other.

7. The gas-air mixing device of claim 1, further comprising a main valve, which is an on/off valve and operates as an opening/closing valve, wherein the main valve is connected to the inlet portion of the gas supply tube.

8. The gas-air mixing device of claim 1, further comprising a blower for supplying air required for combustion, wherein the blower is connected to an outlet portion of the air supply tube.

9. A gas-air mixing device used in a gas boiler, comprising:
a gas supply tube including a first gas flow path and a second gas flow path;
an air supply tube connected to the gas supply tube and including a first air flow path disposed at an upper side of the air supply tube and a second air flow path disposed at a lower side of the air supply tube;
an air flow path branching apparatus for dividing the first air flow path and the second air flow path within the air supply tube;
a drive unit disposed within the air supply tube and having a rod that moves vertically up and down and a valve body connected to the rod,
wherein the first gas flow path extends up to a boundary of the first air flow path and the second air flow path and is connected to the air flow path branching apparatus, and
wherein the drive unit is configured such that the first gas flow path and the first air flow path are simultaneously opened or blocked by the valve body according to a movement of the rod.

10. The gas-air mixing device of claim 9, wherein the air flow path branching apparatus includes two air flow path guides that respectively extend in left and right directions along the longitudinal direction of the air supply tube, and wherein the first gas flow path is connected to the two air flow path guides.

* * * * *